United States Patent [19]

Mitter

[11] 4,307,662

[45] Dec. 29, 1981

[54] APPARATUS FOR PRINTING ON WEBS

[76] Inventor: Mathias Mitter, Falkenstrasse 57, 4815 Schloss Holte, Fed. Rep. of Germany

[21] Appl. No.: 62,533

[22] Filed: Jul. 31, 1979

Related U.S. Application Data

[63] Continuation of Ser. No. 836,478, Sep. 26, 1977, abandoned.

[30] Foreign Application Priority Data

Sep. 25, 1976 [DE] Fed. Rep. of Germany ..... 2643226
Nov. 27, 1976 [DE] Fed. Rep. of Germany ..... 2653912

[51] Int. Cl.[3] ..... B41L 13/18; B41L 13/02

[52] U.S. Cl. ..... 101/123; 101/120; 101/126; 101/127.1

[58] Field of Search ..... 101/127.1, 123, 126, 101/120, 124, 172, 127

[56] References Cited

U.S. PATENT DOCUMENTS

| | | | |
|---|---|---|---|
| 1,328,368 | 1/1920 | Cotoli | 101/129 |
| 2,206,176 | 7/1940 | Foard | 101/126 |
| 2,207,818 | 7/1940 | Perry | 101/123 |
| 2,369,290 | 2/1945 | Foard | 101/126 |
| 2,565,218 | 8/1951 | Freeborn | 101/127.1 |
| 2,651,988 | 9/1953 | Thomas | 101/123 |
| 2,710,577 | 6/1955 | Prett | 101/126 |
| 3,137,230 | 6/1964 | Ichinose | 101/123 |
| 3,138,095 | 6/1964 | Wells | 101/123 |
| 3,252,411 | 5/1966 | Black | 101/129 |
| 3,536,005 | 10/1970 | Derrickson | 101/129 |
| 3,618,838 | 11/1971 | Schieren | 198/689 |
| 3,628,654 | 12/1971 | Horacz | 198/689 |
| 3,921,520 | 11/1975 | Zimmer | 101/123 |

FOREIGN PATENT DOCUMENTS

| | | | |
|---|---|---|---|
| 1132565 | 7/1962 | Fed. Rep. of Germany | 101/123 |
| 2544808 | 4/1976 | Fed. Rep. of Germany | 101/123 |
| 2632490 | 4/1977 | Fed. Rep. of Germany | 101/123 |
| 451548 | 9/1949 | Italy | 101/126 |
| 518036 | 2/1940 | United Kingdom | 101/126 |
| 878094 | 9/1961 | United Kingdom | 101/123 |
| 1026326 | 4/1966 | United Kingdom | 101/126 |

*Primary Examiner*—Clyde I. Coughenour
*Attorney, Agent, or Firm*—Michael J. Striker

[57] ABSTRACT

The apparatus has a gas-permeable support for a web to be printed. Below the support is a suction box which applies suction through the support to the web. Above the support is a flat printing stencil which can be raised and lowered relative to the support. Above and in wiping contact with the stencil is a printing-medium container whose outlet discharges printing medium onto the stencil, to pass through the same and be drawn by the suction of the suction box into the web. The container can move to and fro over the stencil.

21 Claims, 13 Drawing Figures

2
20
21
22
23
23a
23b
120
120a
121
221
221'
III 68
60
c
60
360
460
b
65
66
P
268
460
168
69
60
360
460
a
65
66
P
268
221
68
460
168
69
169
2

68
68
268
168

APPARATUS FOR PRINTING ON WEBS

This is a continuation of application Ser. No. 836,478, filed Sept. 26, 1977 now abandoned.

BACKGROUND OF THE INVENTION

1. Field of the Invention

The present invention relates to an apparatus for printing on webs in form of individual sheets or of continuous bands, particularly—but not exclusively—textile webs.

More particularly, the invention relates to a screen- or stencil-printing apparatus.

2. The Prior Art

There are two basic types of screen-printing apparatus, the flat-screen (stencil) type and the type which uses an endless travelling screen band or belt.

A flat-screen type has been disclosed in German Allowed Application (DAS) No. 1,252,167 where the web to be printed travels between a stationary suction box and a vertically superposed, equally stationary printing-ink container. A flat screen stencil is interposed between the container and the web to produce the desired printed pattern. This apparatus requires, in addition to the printing-ink container, a squeegee which is needed to achieve a reasonably uniform distribution of the ink over the entire screen stencil. Absent the use of such a squeegee, uniform ink distribution is not to be obtained so that the printed pattern will then be non-uniform.

An endless-belt screen printing machine is known from U.S. Pat. No. 2,419,695. The screen is arranged in tubular form and rotates; located within its confines is a rotary squeegee. Located beneath the line of ink application to the web is a stationary suction device. Unlike the flat-screen type, this apparatus has relatively minor problems in respect to uniform ink distribution. In the flat-screen type of apparatus the squeegee—usually a roller squeegee—must move to and fro over the screen and ahead of it (as considered in the direction of its movement) the squeegee pushes a more or less extensive body of ink over the screen. This ink is difficult to distribute uniformly, especially over a flat screen having a large surface area, so that the printing results of flat-screen machines are often unsatisfactory.

SUMMARY OF THE INVENTION

It is an object of the invention to overcome the disadvantages of the prior art.

More particularly, it is an object of the invention to provide an improved flat-screen printing apparatus which is not possessed of the aforementioned disadvantages.

Another object is to provide an apparatus of the type in question, wherein the undesired collection of printing medium in form of pools or the like in the vicinity of the squeegee is avoided.

Still a further object is to provide such an apparatus wherein the printing medium will be uniformly distributed over the entire printing screen, even when the same has a large surface area.

In pursuance of these objects and of others which will become apparent hereafter, one feature of the invention resides in an apparatus for printing on webs, particularly—but not exclusively—on textile webs. According to one aspect of the invention such an apparatus may comprise an apparatus for printing on webs, particularly textile webs, comprising a gas-permeable support for a web to be printed and having an upper side and a lower side; a suction box at the lower side of the support; a flat stencil above the upper side of the support; means for raising and lowering the stencil with reference to the upper side; a printing-medium container above the stencil to discharge printing medium onto the same; and means for moving the container to and fro over the stencil.

In an apparatus according to the invention the printing-medium container itself performs the function of a squeegee, so that a separate squeegee (and the components associated therewith) is not required. The disadvantages of the prior art are avoided, as will become apparent during the subsequent disclosure.

A further important aspect of the invention resides in the construction of the flat screen (stencil) itself. The stencil has two end portions which are spaced from one another in the direction of movement of the printing-medium container. At least one of these end portions (which is relatively wide, as considered in this direction of movement) is made impermeable to fluid, i.e. to gas and to the printing medium. When the outlet opening of the printing-medium container moves onto this end portion, no printing medium can escape from it. At the same time, the influence of the suction force exerted by the suction box upon the printing medium in the outlet opening is interrupted while the outlet opening overlies this end portion. The undesired issuance of printing medium while the outlet overlies the end portion is thus avoided, so that no pool or pools of printing medium can form which would subsequently cause uneven printing on the web and/or the formation of stripes of schlieren in the pattern printed on the web (e.g. sheets or bands of textiles such as carpets, rugs, fabrics, or of paper, plastic or the like).

To obtain even more uniform results it is advantageous if both of the aforementioned end portions are made impermeable to fluid. This assures that printing takes place only while the container travels over the central printing (i.e. permeable) part of the screen intermediate these end portions (the suction box can travel in unison with and beneath it), while in the end positions (i.e. when the container is located over one or the other of the end portions) no printing medium can escape to be lost and/or to form undesired pools.

According to another aspect of the invention the suction opening of the suction box may be blockable, or the suction passage leading to it may be blockable. This permits the suction in the suction box to be maintained even while the screen is raised (to remove a printed web or web section and put a new one in place) and the apparatus is ready for immediate resumption of operation (with a uniform suction) as soon as the screen has been lowered into place again.

The advancement of the web to be printed is customarily effected stepwise in flat-screen printing apparatus. The same approach is adopted in the apparatus according to the present invention. The web may advantageously be supported on a mesh fabric (e.g. wire mesh) or other gas-pervious support band which may be endless and serve as a printing blanket. The band may be advanced stepwise and after each such advancement one (or a battery of two or more successively arranged) flat printing screens (each of which can be raised and lowered relative to the upper web-supporting surface of the band) prints upon the next web increment or web portion. The purpose of making the screen liftable is to permit free advancement of the web after every printing episode.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing. dr

DESCRIPTION OF THE PREFERRED EMBODIMENTS

An exemplary embodiment of the invention is illustrated in FIGS. 1–12.

Figure 1:
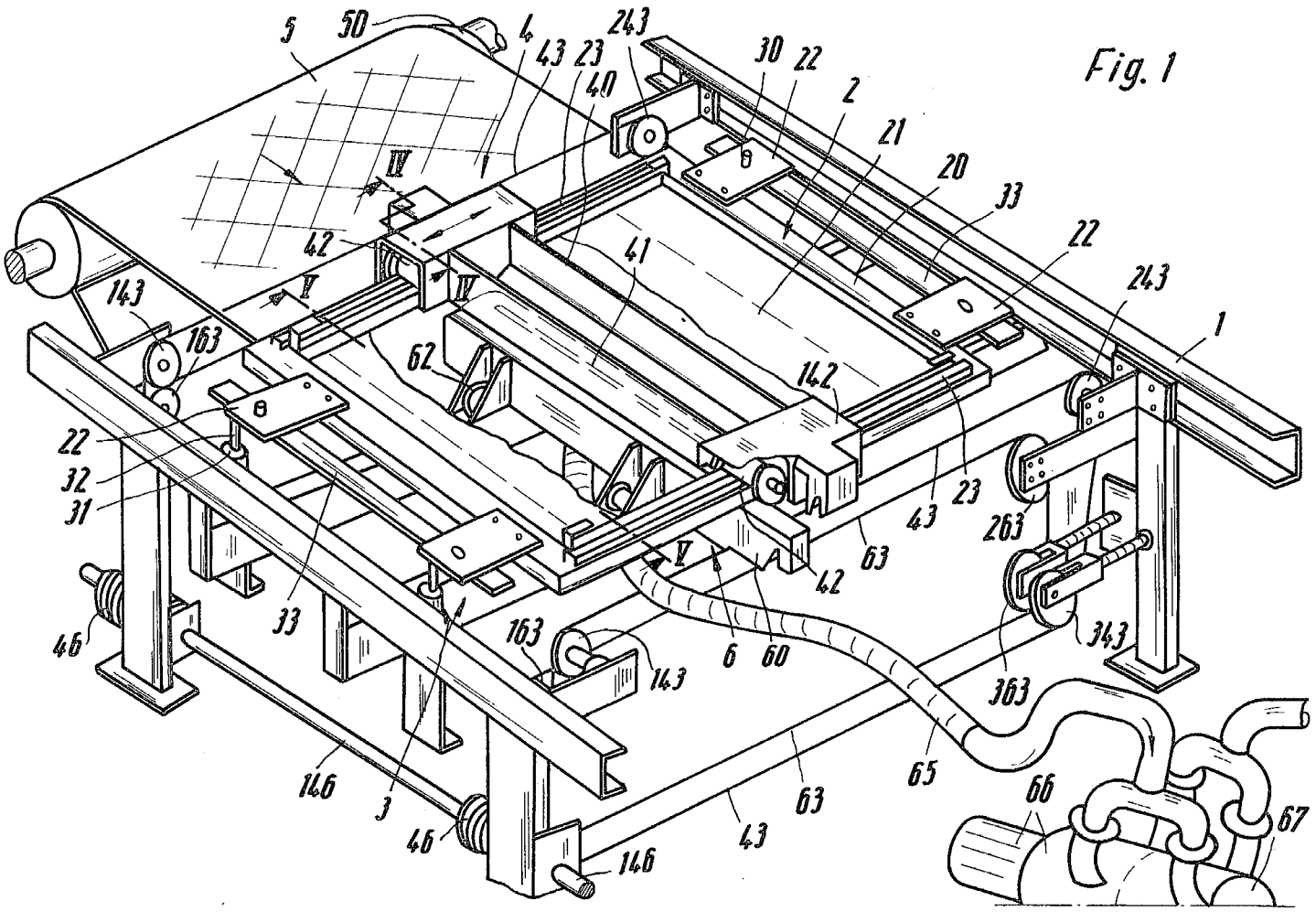
FIG. 1 is a partly broken-away perspective view, illustrating an apparatus according to the invention.

As shown in FIG. 1 the apparatus has a frame 1 which supports a flat-screen stencil unit 2 composed of a flat screen 21 and a frame 20 in which the screen is mounted. Frame 20 has lugs 22 which are supported on centering tips 30 of an arrangement 3 for raising and lowering the stencil unit 2. The arrangement 3 is composed of fluid operated cylinder and piston units 31 having piston rods 32. Four of the units 31 are provided, two at one side and two at the opposite side of the stencil unit 2. The piston rods 32 of the units 31 located at one and the same side respectively engage a bar 33 which is provided with a pair of the centering tips 30 that operate with the respective lugs 22. Depending upon whether the piston rods 32 are extended or retracted the stencil unit 2 is either raised or lowered.

At two parallel transversely spaced side edges of the frame 20 of the unit 2 rails 23 are secured on which the printing-medium unit 4 can move. Details of the rails 23 will be discussed subsequently.

Beneath the stencil unit 2 travels an endless screen or otherwise gas-permeable support band or belt 5 which serves as a printing blanket and as a support for the workpiece web (not shown) to be printed. The belt 5 may be engaged along its lateral edges by parts of the machine frame or other machine parts, but does not have a supporting table beneath its upper web-supporting run because it must be fully permeable. Only a portion of the belt 5, together with one of the reversing rollers 50 about which it is trained, is illustrated in FIG. 1, it being understood that the arrangement of the front of the machine (i.e. at the other side from the one where the roller 50 is shown) is identical thereto. The use of such bands per se is already known and will of course be understood that the band will be appropriately advanced by rotating one of the rollers 50 and that the band will also be maintained tensioned by appropriate (not illustrated) tension rollers or the like. The web will rest upon the upper surface of the upper run of the band 5 (where the arrow is shown in FIG. 1) and will advance with the band 5 in the direction indicated by the arrow. The web may be either a continuous web or it may be in form of individual sheets. The band 5 may cooperate with a plurality of the arrangements shown in FIG. 1, each having a stencil unit 2 and the associated components still to be described.

One of these components is the printing medium unit 4 which has a printing unit container 40, a bottom wall of which faces the screen 21 and is provided with a slot-shaped opening 41 which may be variable as to its cross-sectional area. The ends of the container 40 are supported on rollers 42 which are arranged in respective housings 142 forming a part of the container. A rope drive is provided, including a rope 43 (the term rope is here to be understood as including wires or the like) to which the container 40 is releasably clamped, as indicated in FIG. 4.

Beneath the container 40 and the stencil unit 2 there is arranged a suction device 6 having a suction box 60 which is also movable to and fro by means of a rope drive having a rope 63 to which it is clampingly secured. Thus, both the container 40 and the suction box 60 can be moved in unison to and fro over the entire width of the printing screen or stencil 21 of the unit 2. Uniform displacement of the container 40 and the suction box 60 in unison with one another is desirable. To assure this the ropes 43 and 63 can both be taken up in the lateral regions of the unit 2 upon identical rope drums 46 which are connected with one another by a common shaft 146 that is driven (FIG. 5) by a common motor 246 having a gearing unit 346 and a coupling 446. The ropes 43 and 63 are trained about reversing rollers 143 and 243 and 163 and 263, respectively, and are maintained taut by tensioning rollers 343 and 363. The suction box 60 is supported on rails 61 by means of rollers 62 mounted on its lower side. The rails 61 are supported on transversely extending beams 161 in the machine frame. Suction is applied to the suction box 60 by means of a flexible hose 65 or other flexible conduit which leads to a suction pump 66.

Figures 2, 2A, 3:
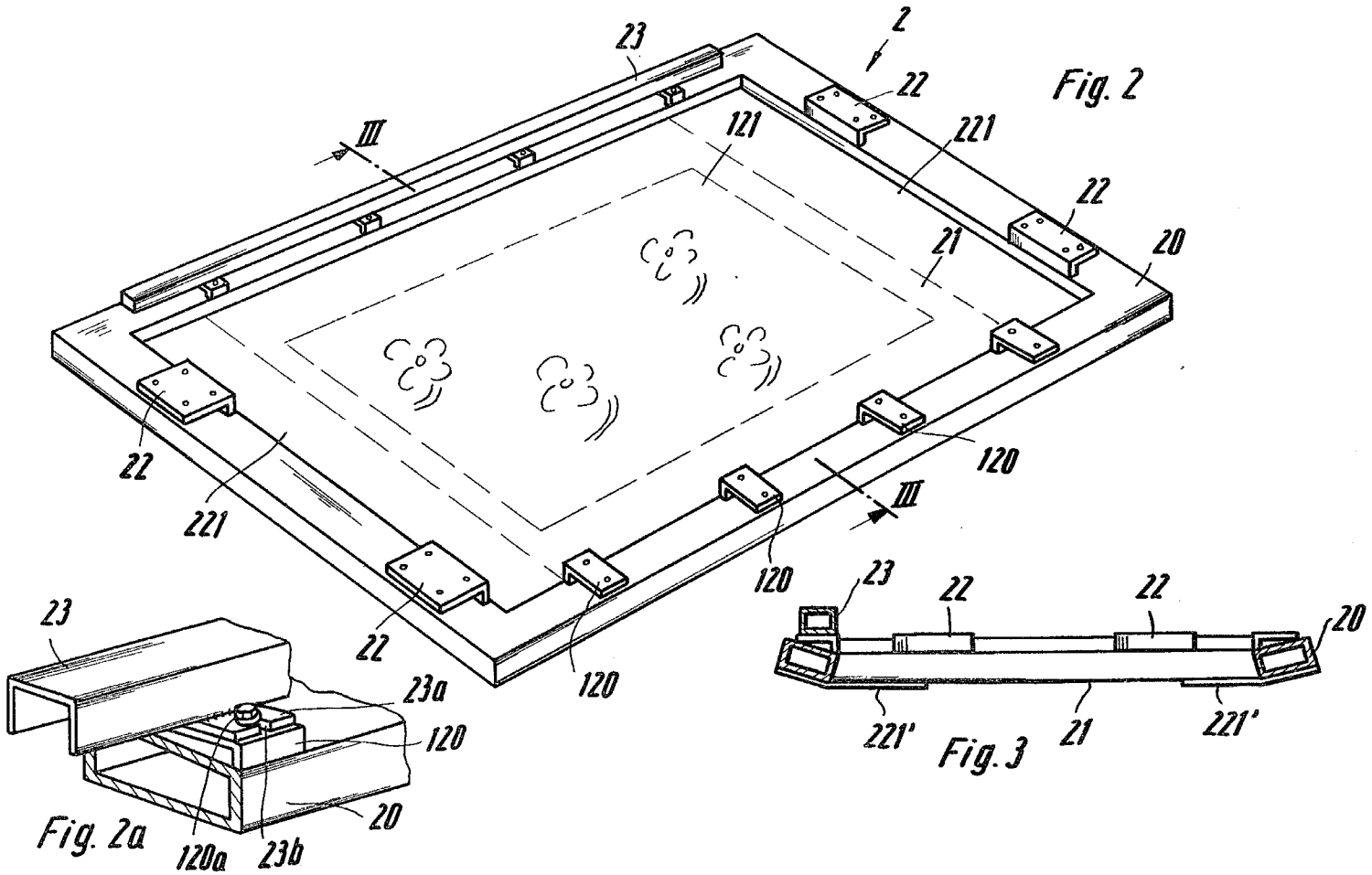
FIG. 2 is a top perspective of a printing stencil used in the machine of FIG. 1.
FIG. 2*a* is a partly sectioned fragmentary perspective showing a detail of FIG. 1.
FIG. 3 is a section on line III—III of FIG. 2.
Figure 4:
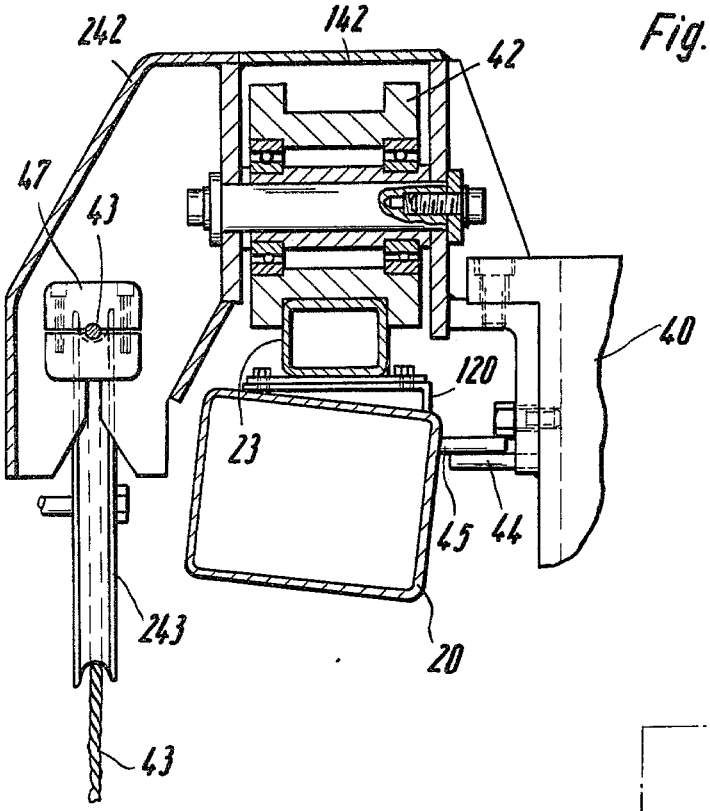
FIG. 4 is a section on line IV—IV of FIG. 1.
Figure 5:
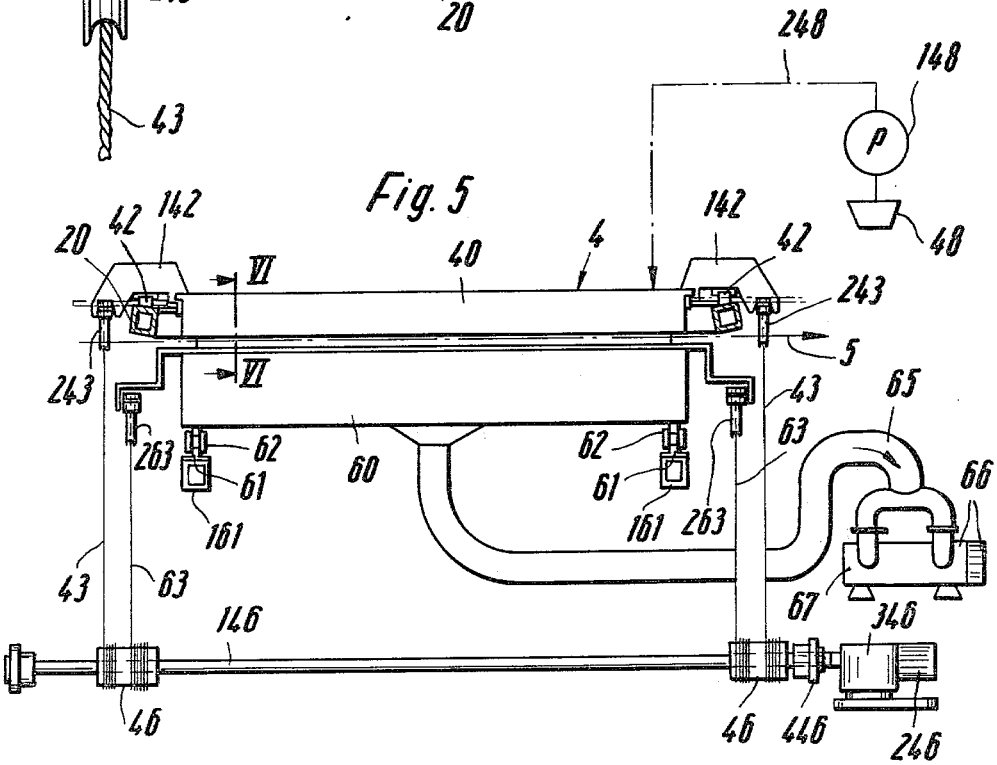
FIG. 5 is a diagrammatic section on line V—V of FIG. 1.

FIGS. 3 and 4 show that the side portions of the frame 20 are inclined and have inclined upper surfaces on which support members 120 are mounted. These support members 120 carry rails 23 (e.g. which are constructed as U-shaped profiles, as solid-cross section bars or as front strips) and which assure a straight-line movement of the container 40. Because the stencil 21 must be maintained taut and due to the necessary tension tends to bow the frame 20, such bowing tends to be transmitted to the rails 23. To compensate for this the rails 23 are mounted on the support members 120 so that they can be adjusted, as shown in FIG. 2*a*, for which purpose the support members 120 are provided with upstanding bolt 120*a* and the rails 23 are provided with lugs 23*a* having a slot 23*b* in which the respective bolt 120*a* is receivable so that the rails 23 can be slid transversely and arrested by tightening the nut and the bolt or tightening the bolt itself if there is no nut.

As FIG. 2 shows the center part of the stencil 21—identified with reference numeral 121—is the printing part, i.e. the part that has the pattern to be printed on to the workpiece web. The center part is flanked by opposite end portions of the stencil 21 and in accordance with the invention at least one—but preferably both—of these end portions is made impermeable to gas and liquid, these end portions that are so sealed being identified with reference numeral 221. This can be done by simply coating the preforations of the stencil 21 so that the end portions become impermeable, or it can be done by placing a synthetic plastic foil or a metallic foil onto the end portions and welding it to them. It is currently preferred, however, to provide a metallic or synthetic plastic plate 222' (see FIG. 3) which is placed beneath the end portions 221 and may be secured to them in suitable manner, so that these end portions thus become impermeable and, when the outlet opening of the printing medium container 40 moves onto them, the outflow of printing medium through the opening is prevented.

Figure 8:
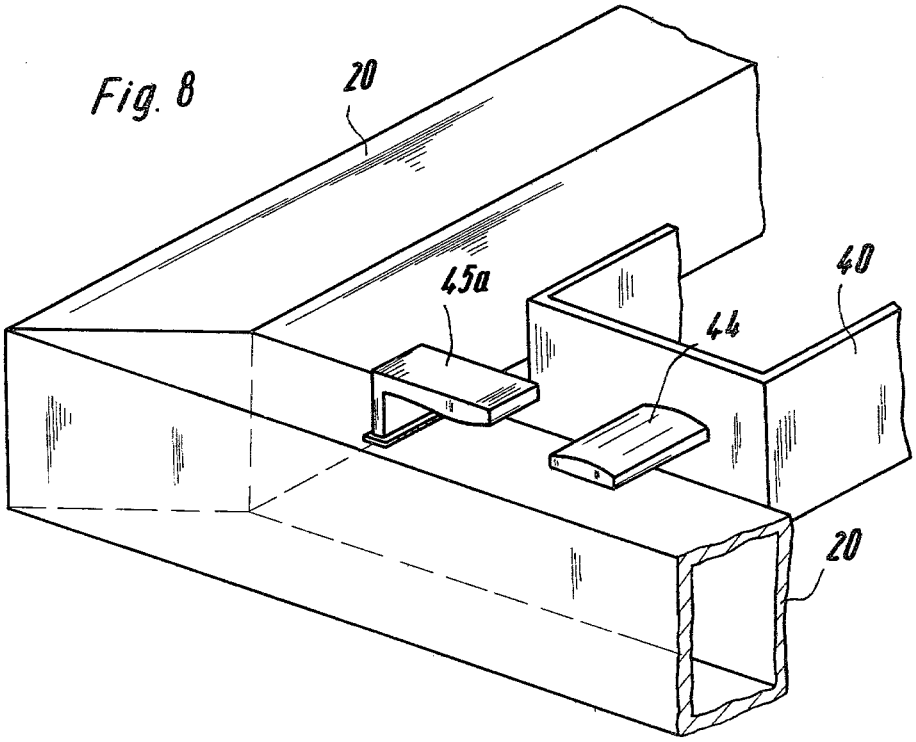
FIG. 8 is a fragmentary, partly sectioned perspective showing an example of an arresting arrangement used in the apparatus according to the invention.

FIG. 4 is a section through one of the roller casings 142 provided at the opposite ends of the container 40. FIG. 4 also shows the means for arresting the container 40 with reference to the frame 20 when it moves into its end positions. The container 40 may be provided at each of its ends with a finger or projection 44 which moves beneath a detent 45 on the frame 20. However, as shown in FIG. 8, other possibilities exist also, for example the one in FIG. 8 where the detent portion 45*a* is angled and mounted on the surface of the frame 20 whereas in FIG. 4 it projects from a side wall of the frame 20.

FIG. 4 also shows that the rollers 42 are provided with recesses so that they straddle the rails 23 to assure that the container 40 is properly guided. The rollers are arranged pairwise, preferably adjacent to one another, in the casing 142 which is also provided with a clamping coupling 47 that engages with the rope 43 but can be released from the same.

Figure 6:
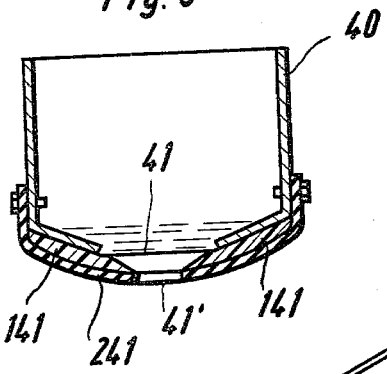
FIG. 6 is a section on line VI—VI of FIG. 5.
Figure 7:
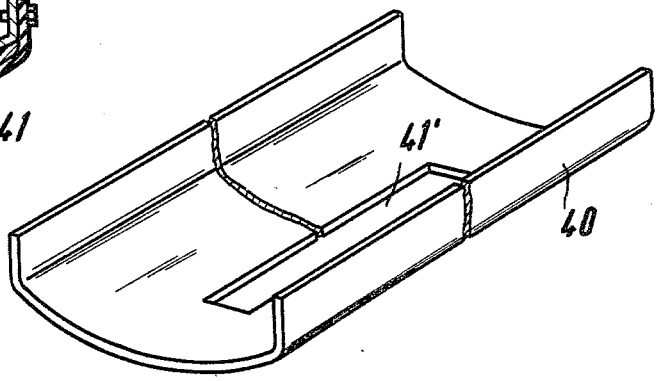
FIG. 7 is a perspective view of the printing-medium container shown in FIG. 6.

FIGS. 6 and 7 illustrate the details of the container 40 which will be seen to be provided in its bottom wall with an open slot-shaped outlet 41. Beneath the underside of the bottom wall there are provided elastically yieldable plates 141 (preferably of natural or synthetic rubber or synthetic plastic material) which may connected with one another and which serve to compensate for unevenness of the stencil 21 of tolerance variations. They assure an exact seal between the container 40 and the stencil 21. Located beneath them but still part of the container 40 is a foil-like cover 241 having a low coefficient of friction, for example polytetrafluoroethylene (commercially available under the tradename Teflon) which is secured to the container 40 and provided with a slot-shaped opening 41' which is the actual outlet for the printing medium in the container 40. The cover 241 is replaceable and can be replaced with another cover having a different outlet 41' (e.g. larger or smaller) so that the final configuration of the outlet from the container 40 can be determined and varied in this manner.

Figure 9:
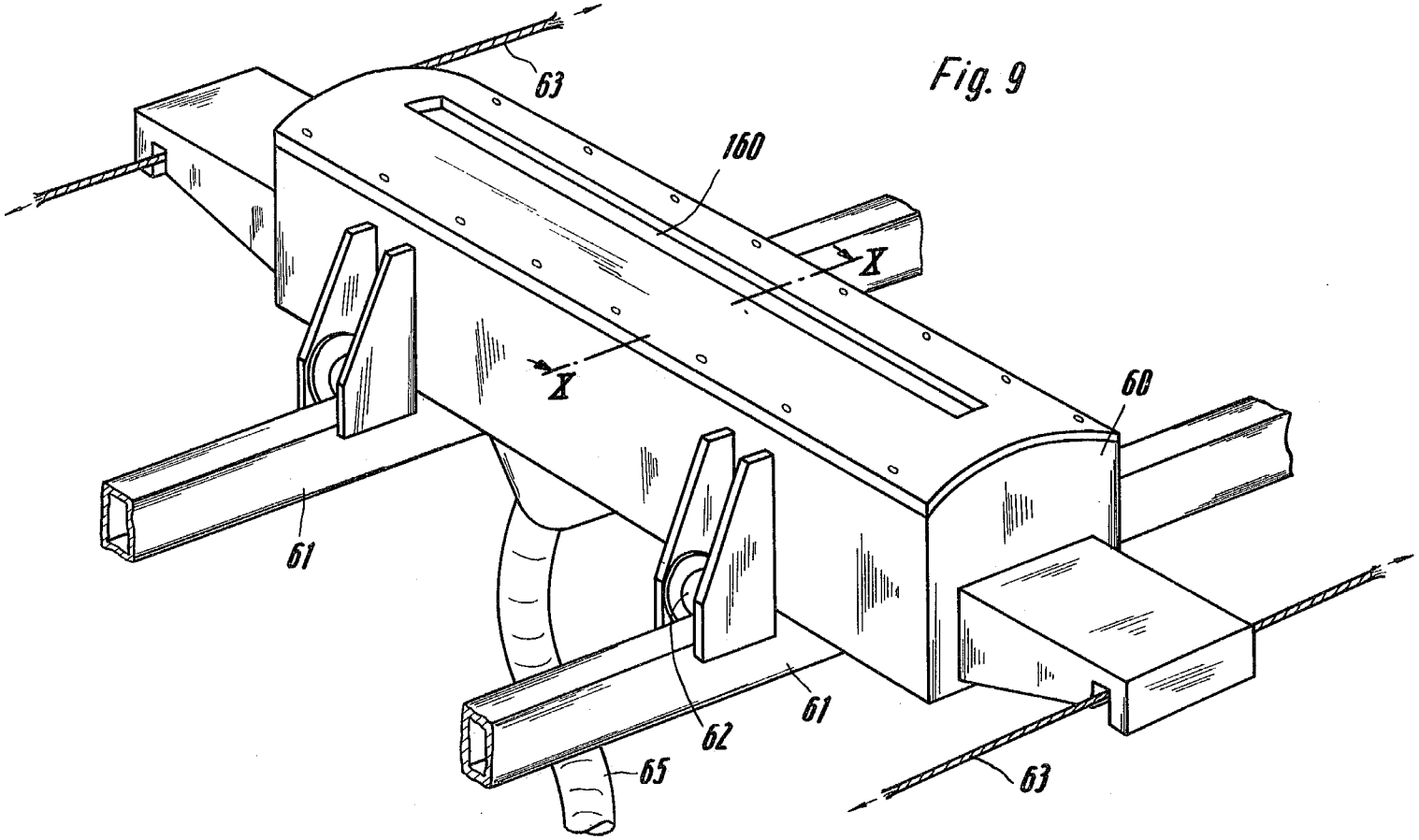
FIG. 9 is a perspective view of the suction box in the novel apparatus.
Figure 10:
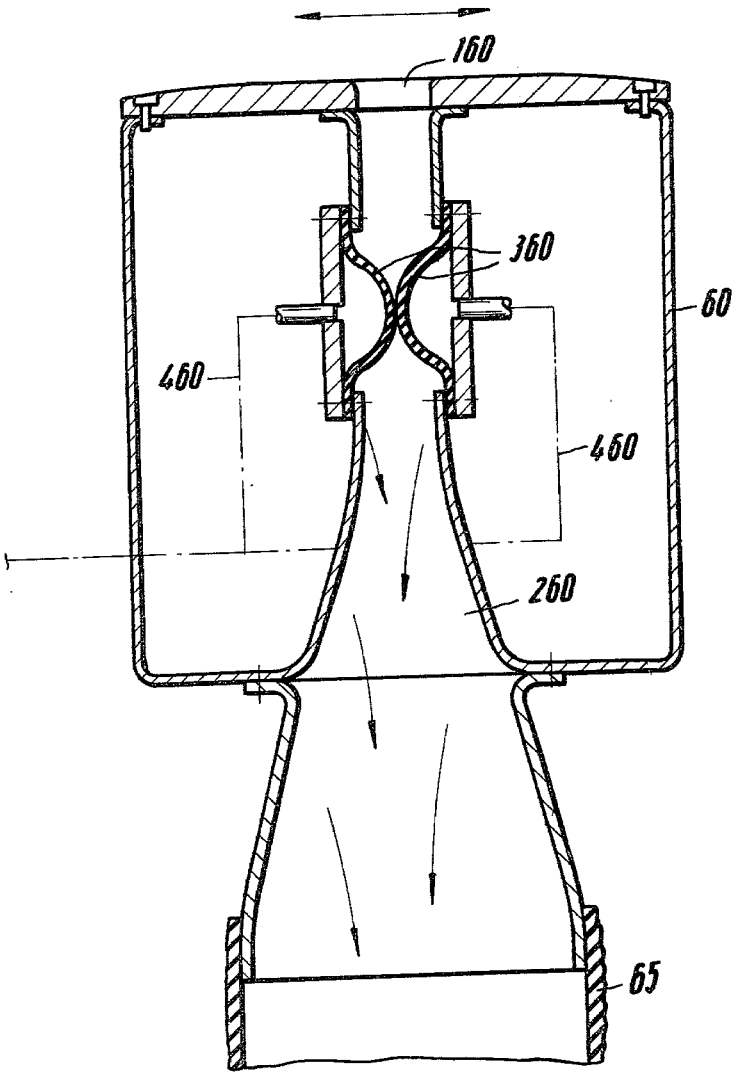
FIG. 10 is a section on line X—X of FIG. 9.

FIG. 9 shows that the suction box 60 has the previously mentioned rollers 62 which are supported on guide rails 61 and that it is connected to the rope 63 of its associated rope drive, of which there is one located at each end of the suction box 60. The upper wall of the suction box 60 is provided with an elongated slot-shaped suction opening 160 which faces the lower side of the upper wall of the permeable band 5. The length and width of the opening 160 are substantially identical to the length and width of the slot-shaped outlet opening 41' of container 40. It will be remembered from what has been said previously that whenever the workpiece web is to be advanced the stencil unit 2 is lifted upwardly to permit such advancement. Whenever this takes place the supply of suction force to the slot 60 must be interrupted so that a suction loss in the conduit 65 is avoided. If such a suction loss were to take place, then whenever the stencil unit 2 is lowered back into operating position it would be necessary to wait until the suction has built up again before printing could resume. This would lead to a non-uniform drawing of the printing medium through the stencil 21 and into the workpiece web. The same is of course true also when the screen unit 2 is not merely lifted for purposes of advancing of the web, but is taken away completely for repair and/or replacement. FIG. 10 shows clearly that the suction box 60 has in its interior a suction channel 260 which communicates with the conduit 65 as well as the suction opening 160. The direction of advancement to and fro of the suction box 60 is identified by the double-headed arrow in FIG. 10. To interrupt the application of suction to the suction opening 160 the suction channel 260 has interposed in it a diaphragm seal 360 composed of two deflectable diaphragms which are located opposite one another and which can be flexed toward each other to the illustrated position, to thereby engage one another and block the passage of fluid through the channel 260. This takes place when compressed air or other compressed gas is admitted against their surfaces which face away from one another so that the diaphragms bulge to the illustrated position and then sealingly engage one another. Compressed air or other fluid is supplied via the conduits 460.

Figures 11, 12:
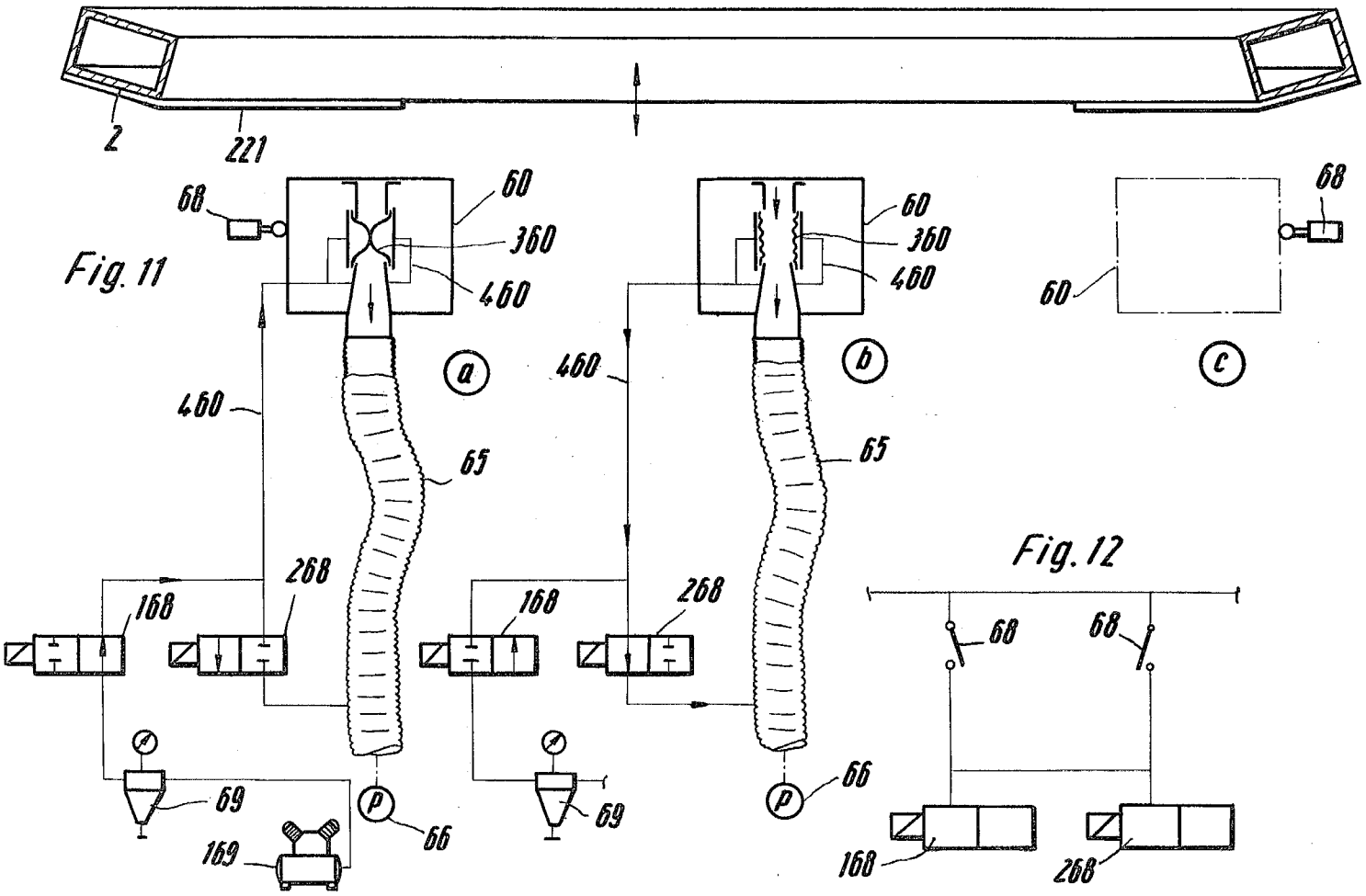
FIG. 11 is a somewhat simplified diagrammatic showing of an arrangement for interrupting the application of suction to the suction opening of the suction box; and, FIG. 12 is a circuit diagram showing the electrical circuit of the arrangement in FIG. 11.

FIGS. 11 and 12 diagrammatically show the operation of the sealing system and the electrical circuit of the same. FIG. 11 also includes a showing of a portion of the frame of the unit 2, to make it clear in which region with reference to the frame and to the stencil 21 the suction box 60 will be located in the different operating positions.

The suction box 60 can move between two end positions in either of which it is located beneath one of the plates 221. Associated with these end positions are limit switches 68 which act upon electromagnetically operated valves 168 and 268 for the supply of compressed fluid to the diaphragm seal 360. The suction box 60 moves together with the container 40 to and fro relative to the printing screen or stencil 21 and when it reaches one or the other of its end positions it engages the respective limit switch 68 which it trips. In response to such tripping the limit switch opens or closes the associated valves and thus opens or closes the diaphragm seal 360. When closed the diaphragms of the seal 360 assume the position shown in FIG. 10 (also the position a in FIG. 11) whereas when open they simply hang loose as shown at the position b in FIG. 11 and permit the flow of fluid through the suction channel 260.

When the printing screen unit 2 is to be replaced with another one or when it is raised up to permit advancement of the workpiece web, the collapse of the vacuum in the conduit 65 must be prevented. For this purpose the limit switch 68 which is respectively engaged by the suction box 60 when the same reaches the respective end position, closes the valve 268 and opens at the same time the valve 168 permitting compressed fluid to enter the seal 360 and distend the diaphragms thereof into the sealing position shown in FIG. 10 and shown in the position a of FIG. 11. Thus, the suction in the conduit 65 remains unchanged and is immediately applied again to the container 40 when the unit 2 is lowered and when the direction of movement of the suction box 60 is reversed so that it releases the respective limit switch 68 which then switches off the valve 168 and switches on the valve 268.

FIG. 11 shows that the valve 268 is connected to the suction line of the suction box 60 so that the suction in the line can be used to open the seal of the diaphragm seal 360, i.e. to collapse the diaphragms from the position a in FIG. 11 to the position b in FIG. 11. Of course, in place of the electromagnetic valves 168 and 268 it will be possible to use pneumatically operated vacuum valves also, or analogous devices. In FIG. 11 the position a is the one in which the seal 360 seals the suction conduit 260, the position b is the one in which the seal 360 opens the suction channel 260 to the suction opening 160, and the position c (illustrated only diagrammatic) equals the position a and has been shown only for completeness. It is clear that in both of the end positions (a and b) the disdiaphragm seal 360 is tightly closed and the loss of vacuum is avoided. In the middle or working position b the diaphragm seal is open and vacuum or suction is applied through the stencil 21 to the container 40 via the suction opening 160. Reference numeral 69 in FIG. 11 identifies a pressure reducing valve which is interposed in the compressed-fluid line 460 leading from the seal 360 to the compressor 169.

The Operation

When the stencil unit 2 is put in place in the machine it is centered on the centering tips 30 of the lifting and lowering device 3, and coupling clamps 47 at opposite ends of the container 40 are embraced by the casings 142 whose hood-shaped portions 242 move over the couplings 47 so that a substantially instantaneous connection is established between the container 40 and the rope drive 43 without requiring long connecting work. At the time the container 40 is so located that its outlet openings is located above one of the plates 221, and the suction box 60 is located directly below it. The apparatus is now in readiness for operation, the printing medium (e.g. ink or any other suitable medium) having already been pumped or otherwise filled into the container 40 as diagrammatically illustrated in FIG. 5 where the ink supply is identified with reference numeral 40, an ink pump with reference numeral 40, an ink pump with reference numeral 148 and an ink supply line with reference numeral 248.

After the cylinder and piston units 31 of the arrangement 3 have been retracted so that the screen unit 2 has been lowered the motor 246 is energized and the container 40 and suction unit 60 are moved from the position a via the position b to the position c (compare FIG. 11) and during this movement ink flowing from the container 40 is spread by the container 40 itself onto the screen and squeezed through the same onto the underlying workpiece web. When the printing operation is completed the container 40 and the suction box 60 move to either the position a or the position b (FIG. 11) and engage the respective limit switch 68 which causes the diaphragm seal 360 to assume the position shown in FIG. 10 and block the suction channel 260. The cylinder-and-piston units 31 now receive pressure fluid to extend them in upward direction (FIG. 1), thereby raising the unit 2 and the container 40 via the bare 33. The (not illustrated) drive for the band 5 advances the band in the direction of the arrow in FIG. 1 so that a new sheet or a new increment of a workpiece web is placed beneath the screen unit 2, whereupon the screen unit 2 is lowered again, the seal 360 is opened and a new printing episode begins when the motor 246 is energized again. The suction pump 66 operates constantly and is advantageously continuously variable as to the amount of suction which it produces, so that the quantity of ink which is pulled through the screen 21 into the workpiece by the suction can be changed by varying the amount of suction. Depending upon the viscosity of the ink this amount may have to be increased or decreased. Also, the extent to which the workpiece (e.g. a high-napped or low-napped carpet or the like) can absorb ink in a determinant of the amount of ink that must be pulled through per unit time. For example, a high-nap carpet requires more ink to be pulled through per unit time than a low-nap piece of textile material. Of course, it will be understood that for the apparatus to work the workpiece web must be permeable to air, since otherwise no suction can be applied through it to the screen 21 and the container 40.

The invention is susceptible of various modifications which are intended to be encompassed within the protection sought in accordance with the appended claims. For example, the screen unit 2 might be stationary, i.e. it could be fixed rather than being capable of being raised and lowered. Again, the printing screens or units 2 could be used in a whole sequential series, i.e. there could be a series of such units each having a different part of an overall pattern to be printed, and each being removed when one part of the pattern has been printed to be replaced with the next unit 2 having another part of the pattern to be printed. Such replaceability is made simple due to the simple connection of the screen units 2 and the container 40 which do not require any installation, other than that the hoods 242 be placed over and engage the couplings 47.

While the invention has been illustrated and described as embodied in a screen printing apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for printing on webs, particularly textile webs, comprising a machine frame; a gas-permeable support for a web to be printed, said support being mounted on said machine frame and having an upper side and a lower side; a suction-box at said lower side and having an upper wall facing said lower side and provided with at least one suction opening, and also having a suction channel communicating with said suction opening; means for blocking the application of suction force from said channel to said opening, including a diaphragm seal in said suction chamber and comprising distendable diaphragms which is distended condition extend across said channel to engage one another and block the channel; a plurality of flat stencils adapted to be placed in a sequence one after the other in one and the same printing position above said upper side, each stencil having a stencil frame, a stencil screen in said stencil frame, and a combined printing medium container and squeegee device on the stencil frame for discharging printing medium onto the stencil screen; means for raising and lowering each stencil with reference to said upper side of said support; a single drive on said machine frame for moving the respective combined device to and fro over said stencil screen; and coupling means for coupling the device of the respective stencil with said drive in response to placement of each individual stencil in said printing position above said upper side.

2. Apparatus as defined in claim 1, and further comprising means for displacing said suction box to and fro with reference to the respective stencil.

3. Apparatus as defined in claim 1, wherein said suction box is elongated and has an upper wall facing said lower side of said support and provided with a slot-shaped suction opening extending over substantially the length of said suction box.

4. Apparatus as defined in claim 1, wherein said container is trough-shaped and has a bottom wall facing the associates stencil and provided with at least one slot-shaped outlet opening.

5. Apparatus as defined in claim 4, wherein the length and the width of said suction opening are substantially identical to the length and the width of said slot-shaped outlet opening of said container.

6. Apparatus as defined in claim 1, each stencil having two transversely spaced parallel edge portions each provided with a rail, and said container having end portions provided with rollers which engage and are movable on said rails so that said container participates in the raising and lowering of the respective stencil as well as being movable to and fro over the same.

7. Apparatus as defined in claim 1, said container having a bottom wall facing the associated stencil and provided with a slot-shaped outlet in wiping engagement with said stencil, and wherein said stencil has end portions which are spaced from one another in the direction of movement of said container and at least one of which is impermeable to the printing medium so that no printing medium can issue from said outlet when the same is located over said one end portion.

8. Apparatus as defined in claim 7, wherein the other of said end portions is also impermeable to the printing medium.

9. Apparatus as defined in claim 7, wherein said stencil is provided at said end portion with a plate of metallic which is secured to the stencil beneath said one end portion to render the same impermeable to the printing medium.

10. Apparatus as defined in claim 7, wherein said stencil is provided at said one end portion with a plate of synthetic plastic material which is secured to the stencil beneath said one end portion to render the same impermeable to the printing medium.

11. Apparatus as defined in claim 1, further comprising a suction source; means for displacing said suction box to and fro with reference to said support; and a flexible suction conduit connecting said suction box with said suction source.

12. Apparatus as defined in claim 11, wherein said suction source is a variable suction pump.

13. Apparatus as defined in claim 11, further comprising guide rails for said suction box; and rollers supporting said suction box on said guide rails for movement of the suction box relative to said support.

14. Apparatus as defined in claim 1, each stencil including a frame having upper frame surfaces and a stencil screen mounted in said frame; support elements on said frame surfaces; and rails adjustably mounted on said support elements; and wherein each container includes rollers which engage said rails.

15. Apparatus as defined in claim 1, each stencil having two spaced end portions spaced from one another in the direction of movement of the associated container; and further comprising arresting members on said container and at least one of said end portions and engageable with one another when said container approaches said one end portion.

16. Apparatus as defined in claim 15, wherein said arresting members comprise cooperating projections on said stencil and on said container.

17. Apparatus as defined in claim 1, wherein said plates are of elastomeric material.

18. Apparatus as defined in claim 1, wherein said plates are of rubber.

19. Apparatus as defined in claim 1, said diaphragm seal further comprising conduits for compressed air which communicate with said distendable diaphragms, and electromagnetic valves controlling the flow of pressure fluid through said conduits; and further comprising limit switches arranged to be operated when said container reaches respective end positions during its to and fro movement, said limit switches being in circuit with said valves to open to same when operated by said container.

20. Apparatus as defined in claim 1, said container being movable to and from a rest position and having an outlet for the printing medium, said outlet being free from impingement by the suction of said suction box when said container is in said rest position.

21. Apparatus as defined in claim 1, said container having a bottom wall provided with a slot-shaped opening and having an inner side and an outer side which faces said stencil, elastically yieldable plates on said outer side at opposite sides of said opening, and a foil-like cover of synthetic plastic material removably secured on said container and covering said plates, said cover being in wiping engagement with said stencil and defining a slot-shaping print-medium outlet which communicates with said opening of said container.

* * * * *